US005967206A

United States Patent [19]

Milton

[11] Patent Number: 5,967,206

[45] Date of Patent: Oct. 19, 1999

[54] HYDRAULIC LOG SPLITTER WITH DRAG HOIST

[76] Inventor: Bernard W. Milton, 11042 Pfaff Hollow, Wayland, N.Y. 14572

[21] Appl. No.: 09/204,728

[22] Filed: Dec. 3, 1998

Related U.S. Application Data

[63] Continuation of application No. 08/597,712, Apr. 5, 1996, abandoned.

[51] Int. Cl.[6] ..... B27L 7/00

[52] U.S. Cl. ..... 144/195.1; 144/193.1; 144/366

[58] Field of Search ..... 144/4.6, 193.1, 144/195.1, 366

[56] References Cited

U.S. PATENT DOCUMENTS 4,487,239 12/1984 Anderson ..... 144/195.1

4,655,269 4/1987 Hanser et al. ..... 144/195.1

*Primary Examiner*—W. Donald Bray

*Attorney, Agent, or Firm*—Hoffman Stone

[57] ABSTRACT

A log splitter of the kind having a hydraulic ram for driving a log into a confronting wedge for splitting it, the ram and the wedge being mounted on opposite respective ends of a supporting rail. This splitter includes a hydraulically powered drag hoist carried on the rail and controllable separately from and independently of the ram. The hoist carries a relatively long lifeline making it capable of dragging logs from a substantial distance to the rail, as well as lifting the logs up to the wedge. The rail is mounted on retractable wheels making it roadworthy and also adjustable in height to fit the convenience of the operator, the wheels being lockable in position intermediate between their fully lowered and their fully raised positions.

4 Claims, 2 Drawing Sheets

HYDRAULIC LOG SPLITTER WITH DRAG HOIST

This is a continuation of application Ser. No. 08/597,712, filed Apr. 5, 1996, and entitled Hydraulic Power Winch Adjustable Wood Splitter (now abandoned).

BACKGROUND OF THE INVENTION

This invention relates to a hydraulic log splitter combined with an independently controllable hoist enabling dragging of logs from any desired nearby location to the splitter and lifting them into position for splitting.

DESCRIPTION OF THE PRIOR ART

As noted in U.S. Pat. No. 4,487,139, due to the recently increasing cost of heating fuels the practice of burning wood in fireplaces and stoves is becoming more and more popular, and a corresponding increase in the demand for log splitting gear has appeared in the market.

The splitter described in the above cited patent includes a hoist to avoid the need for lifting logs manually to place them on the splitter rail, and has the hoist arranged to operate automatically in response to operation of the splitter ram to lift a log onto the splitter rail into position for splitting. The patent fails, however, to address the problem of delivering the logs to the hoist, limiting itself to relieving the operator of the task of lifting the logs but leaving it to the operator, or his assistants, to carry the logs to within operating range of the hoist.

SUMMARY OF THE INVENTION

The present invention resolves this problem by providing the hoist with a liftline long enough to reach logs lying a considerable distance away, thereby enabling it to drag the logs to the splitter, allowing operation of the entire splitting process without the need for manual handling of the logs, and requiring only that tile logs originally lie within a reasonable distance of the hoist, a distance that can ordinarily be set by the operator. To this end the splitter of the invention is equipped with a hydraulically powered hoist carried on the splitter and positioned to lift a log from the ground to the splitter rail or otherwise in position for splitting. The hoist is controlled by the operator independently of operation of the ram, and is not responsive in any automatic way to the operation of the ram. It is fitted with a liftline of a length determined by the operator in view of his working circumstances to reach logs selected for splitting even though they may lie several yards away.

In use, the operator is relieved of the task of carrying the logs from wherever they may be to the splitter; that chore being taken care of by the hoist with its long liftline, which may conveniently be forty-five feet or more in length. Once the hoist drags a log up to the splitter it simply continues to pull, thus lifting the log to the rail of the splitter, and, once the log is in place, the operator "pulls the trigger" to extend the splitter ram. Manual lifting of the logs is entirely avoided.

The splitter is also equipped with retractable road wheels to facilitate moving it when the wheels are extended, and also adjusting its height to suit the operator's convenience.

BRIEF DESCRIPTION OF THE DRAWING

A presently preferred embodiment of the invention will now be described in conjunction with the drawing, wherein.

DESCRIPTION OF THE PREFERRED EMBODIMENT

Figure 1:
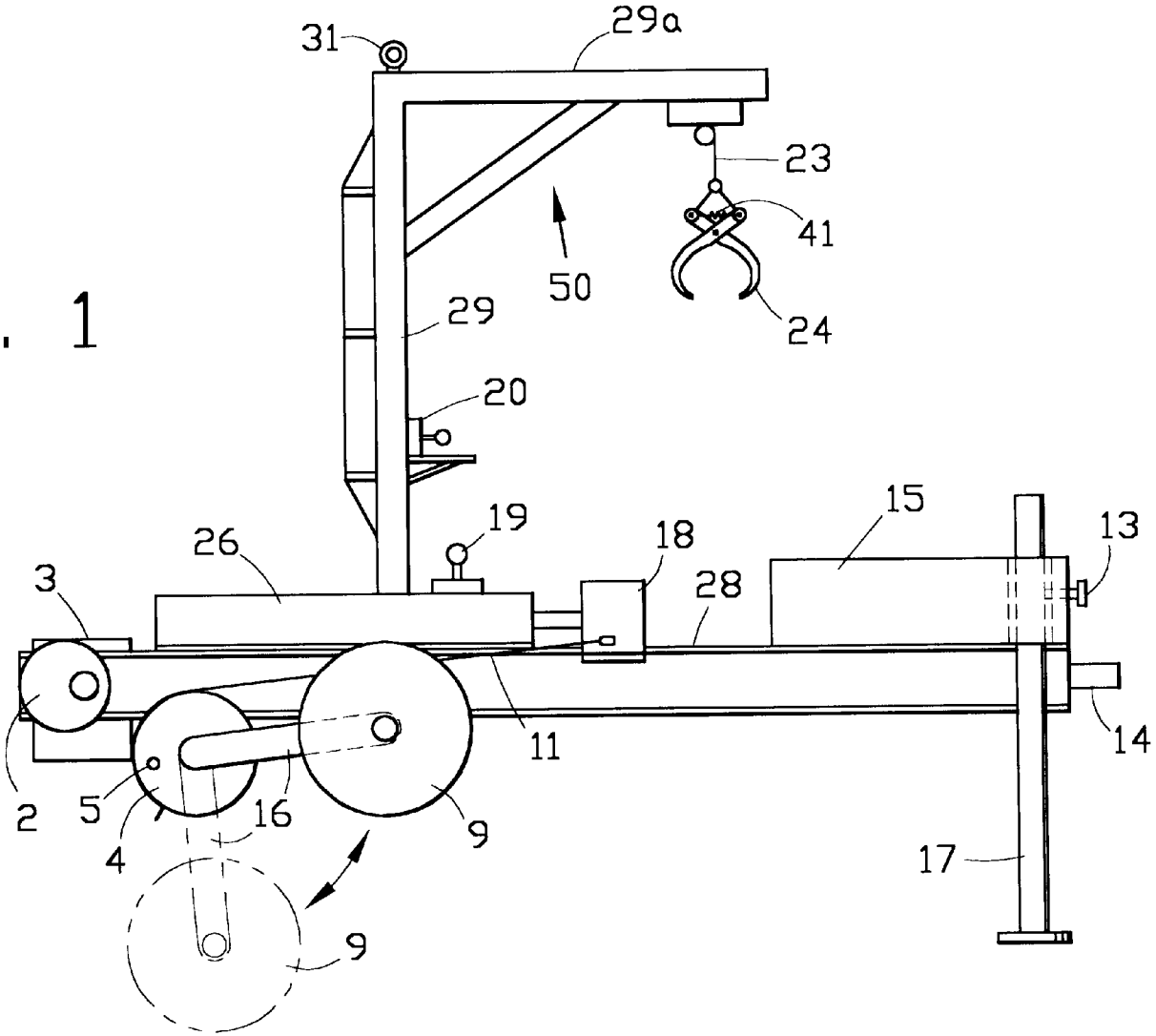
FIG. 1 is a side elevational view of a log splitter according to the invention.

Referring now to the drawing, the splitter as shown includes a hydraulic ram 26 fitted with a pusher block 18 for engaging a log (not shown) to be split by driving it against a splitting wedge 15 fixed at the front of the rail.

Figure 2:
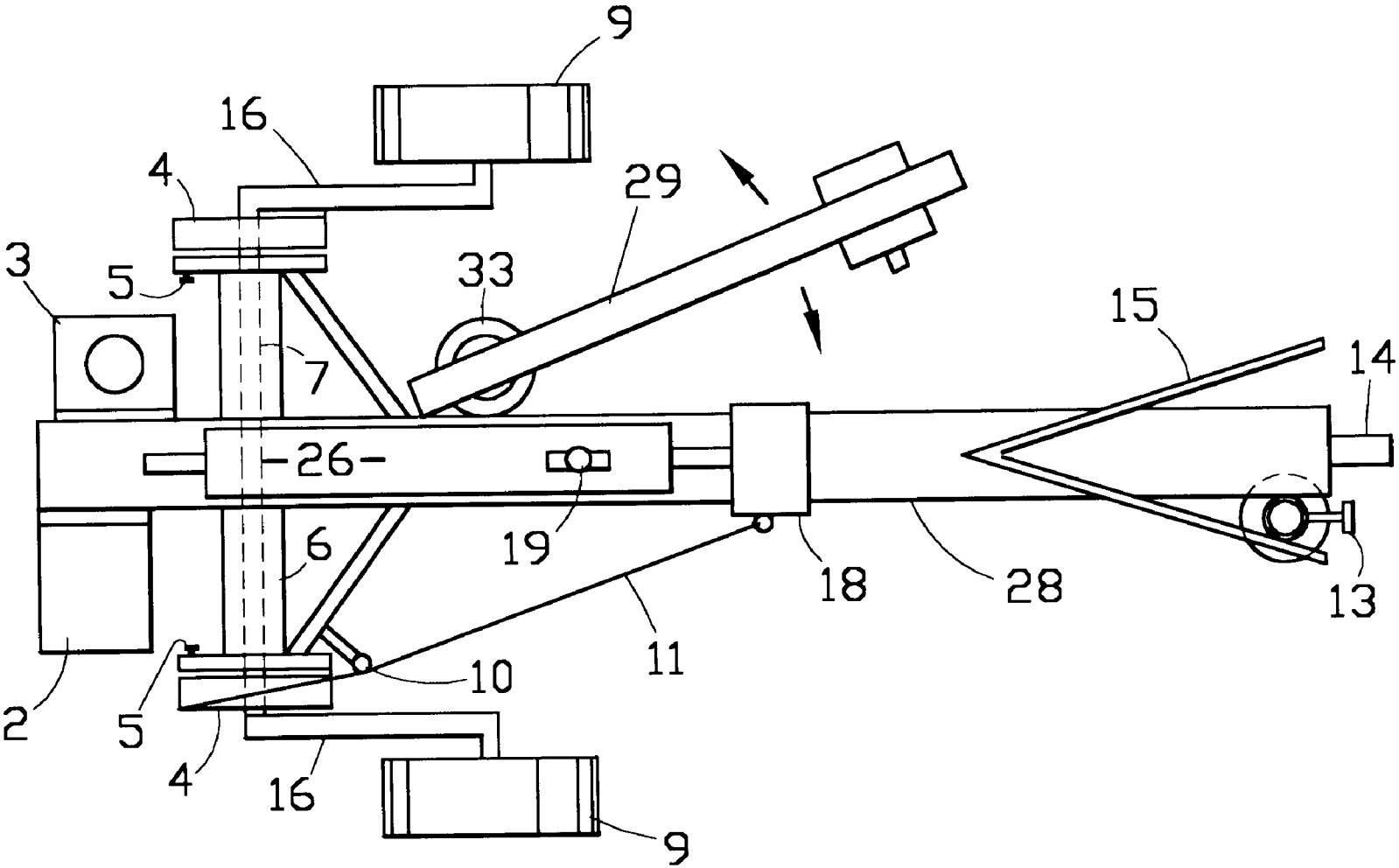
FIG. 2 is a plan view of the splitter shown in FIG. 1.

A hoist, generally referenced 50, is positioned adjacent to the ram 26 and includes a mast 29 supported by and freely rotatable in a cup 33 (FIG. 2) fixed on tile rail 28. A jib, or boom 29*a* extends radially from the top of the mast 29, and a liftline 23 is extended by suitable pulleys (not separately designated) from the distal end of the jib down the mast 29 to a winch drum (not shown)) where, in the ordinary course, much of its length is wound.

A scissors type tongs 24 is secured to the end of the liftline 23, and is biased toward its closed position by a tension spring 41. Normally during lifting of a load tension on the tongs tends to draw them into biting engagement with the load, but in the present case, when the hoist is used for preliminarily dragging a log along the ground there may at times not be enough tension on the tongs to keep them firmly engaged. The tension spring 41 is connected between the handles of the tongs biasing them toward their closed position to avoid any problem in this regard.

A power unit 3 is mounted at the rear of the splitting rail 28, and may include a gasoline fueled internal combustion engine as its primary power source, and a conventional hydraulic pump as its secondary source (neither being separately shown) for driving the ram 26 and the hoist 50.

The power unit 3 also is available selectively and controllably, through operation of the ram, to lower and retract a pair of road wheels 9, making the splitter fully mobile, and also adjustable as to working height. The wheels 9 are mounted at the ends of the legs of a U-shaped frame 16, the bight 7 of which extends through and is rotatable in a transverse tube 6 fixed to the underside of the rail 28 near its rear, the position being selected on the principle of a desired load distribution fore and aft.

The wheels 9 are shown in their retracted position. For adjusting the working height of the rail to suit the operator's convenience, the wheels may be held in any of several intermediate, partly retracted positions by a pair of detent pins 5 that are movable through holes in fixed arms 4 on the tube 6 into and through any of several angularly spaced holes (not shown) in cable drums 4 that are fixed on the bight 7 of the frame.

The cable drums 4 may be used to adjust and set the position of the road wheels 9 for supporting the rear of the rail 28 at a desired height, usually selected by the operator to suit his personal convenience. A cable 11 (only one being shown) for this purpose may be attached between the pusher block 18 and wrapped around the drum 4 after passing by a fixed guide 10. The ram 26 may then be used for lowering the wheels 9 or for retracting them at a controlled rate.

For travel the splitter is fitted with a tow hitch 14 at its front. And a vertically adjustable leg 17 may be locked in position at the front by a setscrew 13 for leveling the rail.

An eye 31 is fitted at the top of the mast 29 for securing one or more guys to stabilize the rig when dragging heavier than normal logs, or when other relatively heavy drag loads may be encountered.

The hydraulic controls of the splitter are simple. A single hydraulic pump may supply the secondary power for both the ram 26 and the hoist 50. The ram power is taken from the pump 2 through an ADVANCE-RETRACT-HOLD valve 19, while the power for the hoist 50 is controlled through another, similar valve 20 for lifting lowering, and holding. When the operator wants to carry the tongs manually away from the splitter to grasp a log spaced from the splitter he uses the conventional manual release to free the hoist winch from the hydraulic worm drive.

Thus, so long as the operator is himself mobile he is enabled to run the log splitter of the invention without lifting or dragging effort, using the hoist 50 to drag the logs from their delivery point to the splitter, have the hoist lift them, and the ram split them. Moreover, he can adjust the height of the splitter rail 28 to suit his convenience, and can tow the splitter using the tow hitch 14 at the front of the rail 28 to hook it to a towing vehicle.

What is claimed is:

1. A hydraulic log splitter of the kind having a main rail for supporting its operating components, a hydraulic ram mounted on said rail near the rear thereof, a splitting wedge fixed on said rail at the front thereof and aimed at said ram for splitting logs pushed against it by the ram, a hydraulically drivable hoist for lifting logs to position them adjacent to the wedge, means supporting said hoist adjacent to said rail enabling it to lift a log and place it on said rail, a hydraulic pump, power means for driving said pump to drive said ram and said hoist, said splitter also comprising control means for controlling the operation of said ram and of said hoist separately from and independently of each other.

2. A log splitter according to claim 1 comprising also a liftline for said hoist much longer than the lift distance from the underlying log support to the splitting position adjacent to said wedge, whereby the hoist is capable of dragging a log from a location spaced a predetermined substantial distance from tile splitter up to the splitter preparatory to lifting it.

3. A log splitter according to claim 1 also comprising a pair of road wheels, support means for mounting said road wheels retractably beneath said rail and alternately lowering and raising them, means for selectively connecting said support means to said ram for driving the wheels between their lowered and their raised positions, and detent means for selectively and alternately securing said wheels in their lowered and in their raised positions and also in selected positions between the lowered and raised positions.

4. A hydraulic log splitter of the kind having a main rail for supporting its operating components, a hydraulic ram mounted on said rail near the rear thereof, a splitting wedge fixed on said rail at the front thereof and aimed at said rail for splitting logs pushed against it by the ram, a hydraulic pump, power means for driving said pump to drive said ram, said splitter also comprising a pair of road wheels, support means for mounting said road wheels retractably beneath said rail and alternately, lowering and raising them, means for selectively connecting said support means to said ram for driving the wheels between their raised and their lowered positions, and detent means for selectively and alternately securing said wheels in their lowered and in their raised positions and also in selected positions between their lowered and their raised positions.

* * * * *